United States Patent [19]

Farnsworth

[11] Patent Number: 5,065,947

[45] Date of Patent: Nov. 19, 1991

[54] METHOD OF SHREDDING CARBON PAPER

[75] Inventor: Thomas L. Farnsworth, Hartville, Ohio

[73] Assignee: Invequest, Inc., North Canton, Ohio

[21] Appl. No.: 530,114

[22] Filed: May 29, 1990

Related U.S. Application Data

[62] Division of Ser. No. 390,411, Aug. 7, 1989, Pat. No. 4,944,461.

[51] Int. Cl.[5] ..... B02C 19/00; B02C 23/00

[52] U.S. Cl. ..... 241/30; 241/27

[58] Field of Search ..... 241/27, 30, 36, 100, 241/236, 282.1, 282.2

[56] References Cited

U.S. PATENT DOCUMENTS

| | | | |
|---|---|---|---|
| 2,533,550 | 12/1950 | Blackwell | 146/122 |
| 2,558,255 | 6/1951 | Johnson et al. | 241/36 |
| 2,886,254 | 5/1959 | Rohlinger et al. | 241/74 |
| 3,088,683 | 5/1963 | Joseph et al. | 241/36 |
| 3,323,728 | 6/1967 | Shepherd | 241/36 |
| 3,612,414 | 10/1971 | Nevison et al. | 241/36 |
| 3,682,402 | 8/1972 | Goldhammer | 241/100 |
| 3,724,766 | 4/1973 | Bosland | 241/100 |
| 4,200,239 | 4/1980 | Simone et al. | 241/36 |
| 4,355,765 | 10/1982 | Parker et al. | 241/152 |
| 4,545,537 | 10/1985 | Kimura et al. | 241/36 |
| 4,615,490 | 10/1986 | Goldhammer | 241/36 |
| 4,650,128 | 3/1987 | Goldhammer | 241/36 |
| 4,664,317 | 5/1987 | Morton | 241/36 |
| 4,828,188 | 5/1989 | Snyder | 241/36 |

*Primary Examiner*—Timothy V. Eley

*Attorney, Agent, or Firm*—Michael Sand Co.

[57] ABSTRACT

A shredder for cutting carbon paper of the type used for credit purchases into indescernible pieces by a high speed cutting blade safely located within an enclosed housing having a lower collection receptacle. A pair of feed rolls moves the carbon paper at a controlled rate through a chute generally perpendicularly into the horizontal cutting path of the blade. One of the feed rolls is power driven by an electric motor. A single push button having a pair of indicating lights controls the drive motors for the blade and for the feed rolls. Depressing of the button while the blade is rotating reverses the blade and feed roll rotation to prevent jamming. Once actuated a timing circuit maintains the blade rotating for generally 10 seconds. A magnet is mounted on the collection receptacle closely adjacent a magnetic switch to provide a safety interlock to prevent the blade motor from being energized when the cover is removed from the collection receptacle. The invention also encompasses a method for shredding carbon paper.

6 Claims, 4 Drawing Sheets

METHOD OF SHREDDING CARBON PAPER

CROSS REFERENCE TO RELATED APPLICATION

This application is a division of pending application Ser. No. 07/390,411 filed Aug. 7, 1989 now U.S. Pat. No. 4,944,461.

BACKGROUND OF THE INVENTION

1. Technical Field

The invention relates to paper shredders and particularly shredders for shredding carbon paper of the type used with credit purchases. More particularly, the invention relates to a compact carbon paper shredder and associated method to be located adjacent the checkout counter or cash register a business establishments.

2. Background Information

The use of credit purchases has grown considerably over the years and is steadily increasing, wherein the purchaser uses a credit card with the transaction being recorded on a document or credit slip containing usually two or more copies separated by carbon paper. A problem has developed in that dishonest individuals will obtain the carbon paper which is discarded after the transaction has been completed and the copies distributed to the appropriate people and locations. Usually one of the copies goes to the customer, with the other two remaining with the business establishment. The used carbons can be read and various information, including the customers name and credit card number, obtained from the carbons and subsequently used by the thief for improper and unlawful credit transactions.

Therefore, it has become the practice upon completion of a credit transaction, that the business establishment personnel or the customer, will manually rip the carbon paper into several pieces and deposit the same in a waste receptacle. However, this is unsatisfactory due to the soiling of the persons hands, fingers and clothes upon tearing of the carbon paper. Also, the carbon paper usually is not adequately destroyed and if the thief has sufficient patience, can easily piece the torn carbon together and obtain the necessary information for making subsequent illegal purchases.

It has been found that usual paper and document shredders are not satisfactory for shredding carbon paper since the carbon paper is relatively thin and of a low mass and is self-lubricating due to the carbon material. Also, the carbon has a relatively high tensile strength making the start of the tear difficult, after which the remaining separation or tearing is more easily accomplished. It has been found that if the carbon paper is passed between two meshing rolls, it usually will not sufficiently disfigure the paper to destroy the confidential information thereon, and if passed between various types of intermeshing cutting blades, can pass completely through the blade without sufficiently shredding the paper. Also even if the carbon is cut into numerous strips as is accomplished by usual document shredders, it can be replaced together if the thief has sufficient patience. Furthermore, most known prior art document shredders are relatively bulky and expensive devices marking their purchase and use at each of the check-out counters, cashiers, or credit transaction locations, impractical and too expensive for most business establishments.

Various types of document shredders and other types of shredding mechanisms have been devised for specific applications, but for certain of the reasons discussed above, would be impractical and unsuitable for the shredding of carbon paper.

Examples of known prior art shredders are shown in U.S. Pat. Nos. 929,960; 2,558,255; 2,886,254; 3,088,683; 3,323,728; 3,612,414; 3,682,402; 3,724,766; 4,200,239; 4,355,765; 4,545,537; 4,615,490; 4,650,128; and 4,664,317.

Therefore the need exists for an improved shredder for shredding carbon paper into a plurality of indiscernible, randomly cut bits of paper in a relatively small, inexpensive and compact unit easily located at each of the cash register locations, which has safety features incorporated therein to prevent possible injury to the clerk or customer, and which has anti-jamming features.

SUMMARY OF THE INVENTION

Objectives of the invention include providing an improved carbon paper shredder and method in which the carbon paper is fed at a predetermined controlled rate by a pair of feed rollers in a generally perpendicular direction into the horizontal path of a rotating cutting blade which is safely contained within an enclosed housing wherein the carbon paper is cut into a vast number of indiscernible pieces which fall by gravity into a collection receptacle located beneath the rotating blade.

Still another objective of the invention is to provide such an improved shredder and method in which the cutting blade is mounted beneath its drive motor enabling the blade to be changed easily without removing the motor from its mounting within a protection cover portion of the housing; and in which at least one of the feed rolls is spring biased toward the other feed roll to provide a positive meshing force therebetween for securely gripping the carbon paper for feeding it through an inlet chute towards the cutting blade.

A further objective of the invention is to provide such an improved paper shredder and method in which the housing is formed primarily of rugged, lightweight plastic; in which a control circuit for controlling the feed roll, drive motor and blade motor includes a magnetically actuated switch which is in close proximity with a magnet mounted on the collection receptacle which will deenergize both drive motors upon removal of the cover from the receptacle to avoid injury to an individual by preventing the motors from being energized when the cutting blade and drive rolls are not fully enclosed within the protective housing.

A still further objective of the invention is to provide such a shredder and method in which the blade is relatively thin and is driven at an extremely high rotational speed of approximately 10,000 rpm, which in cooperation with the feed speed of the carbon paper by the feed rolls, enables the cutting blade to shred the carbon paper into a vast quantity of indiscernible pieces; and in which the feed rolls and cutting blade are mounted on an intermediate section of the housing and located between the cover and collection receptacle, enabling the various components to be serviced easily by providing access to the components by removal of the cover and intermediate section from the lower receptacle.

Another objective of the invention is to provide such a shredder and method in which a single control button, having at least two indicating lights, provides complete control for the shredder; in which the button, if actuated while the blade is rotating, will reverse the direction of rotation of the blade and feed rolls, preventing jamming of the cutting blade; in which a timing circuit is incorporated into the control circuitry of the shredder, providing a time interval of approximately 10 seconds for cutting of the carbon paper after the switch is actuated, eliminating the operator from deenergizing the drive motor after the carbon paper has been shredded and preventing the operator from allowing the unit to remain running even though a piece of carbon paper is not being shredded; and in which a thermal overload protector is provided in the control circuit for automatically deenergizing the drive motors if either of the drive motors over heats.

Another objective of the invention is to provide such a shredder which is formed of relatively inexpensive plastic material to enable the unit to be produced at a relatively low cost; in which the shredder is contained in a compact unit sufficiently small to be located at a customer check-out location in a business establishment; in which the shredder is energized by a usual readily available source of 110 volt AC power, with the control motors being 6 or 9 volt motors so that the possibility of an electric shock is eliminated; in which the blade and feed rolls are completely out of reach when energized preventing injury to the operator and/or customer; and in which the collected shreddings can be disposed of easily by removing the top cover and intermediate section from the lower waste receptacle for subsequent emptying of the shreddings from the receptacle.

These objectives and advantages are obtained by the improved carbon paper shredder of the invention, the general nature of which may be stated as including a housing having an upper cover and a lower receptacle, said receptacle having a top opening for receiving pieces of a shredded carbon paper, with said cover being removably mounted on and covering the top opening of the receptacle and having a chute for feeding carbon paper into the housing; power driven feed rolls mounted adjacent the chute for drawing the piece of carbon paper through said chute and generally perpendicularly into the path of a rotatable cutting blade; an electric motor for rotating the cutting blade at a high speed to shred the carbon paper into pieces which fall into the receptacle; and control means for controlling the rotation of the cutting blade including a single manually actuated control switch for rotating the cutting blade in a forward cutting direction and for reversing the rotation of the cutting blade to eliminate jamming of the cutting blade.

These objectives and advantages are further obtained by the improved method of the invention, the general nature of which may be stated as including the steps of providing a thin cutting blade with a double beveled cutting edge; rotating the cutting blade in a generally horizontal plane at a speed within the range of 8,000 rpm and 12,000 rpm; feeding a piece of carbon paper at a predetermined speed generally perpendicularly into the cutting path of a rotating blade to cut said carbon paper into indiscernible pieces; and collecting the pieces of carbon paper in an enclosed container located beneath the cutting blade.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
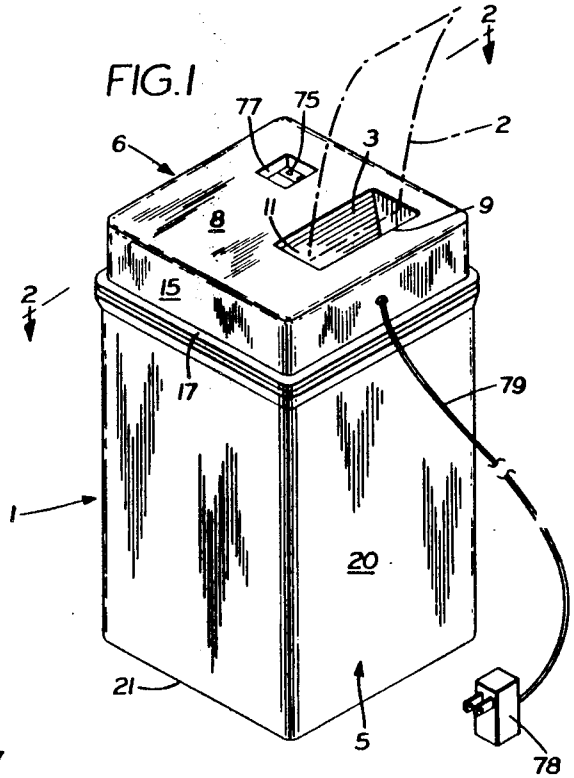
FIG. 1 is a perspective view of the improved carbon paper shredder, showing a piece of carbon paper in dot-dash lines being inserted into the feed chute thereof.
Figure 3:
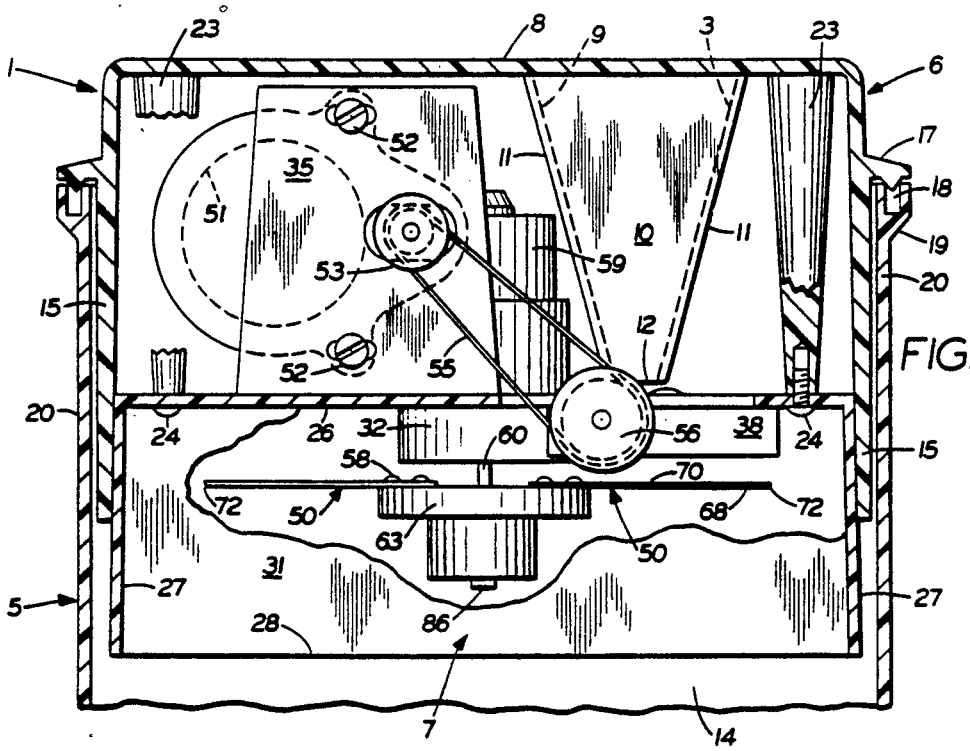
FIG. 3 is a fragmentary sectional view taken on line 3—3, FIG. 2.
Figure 4:
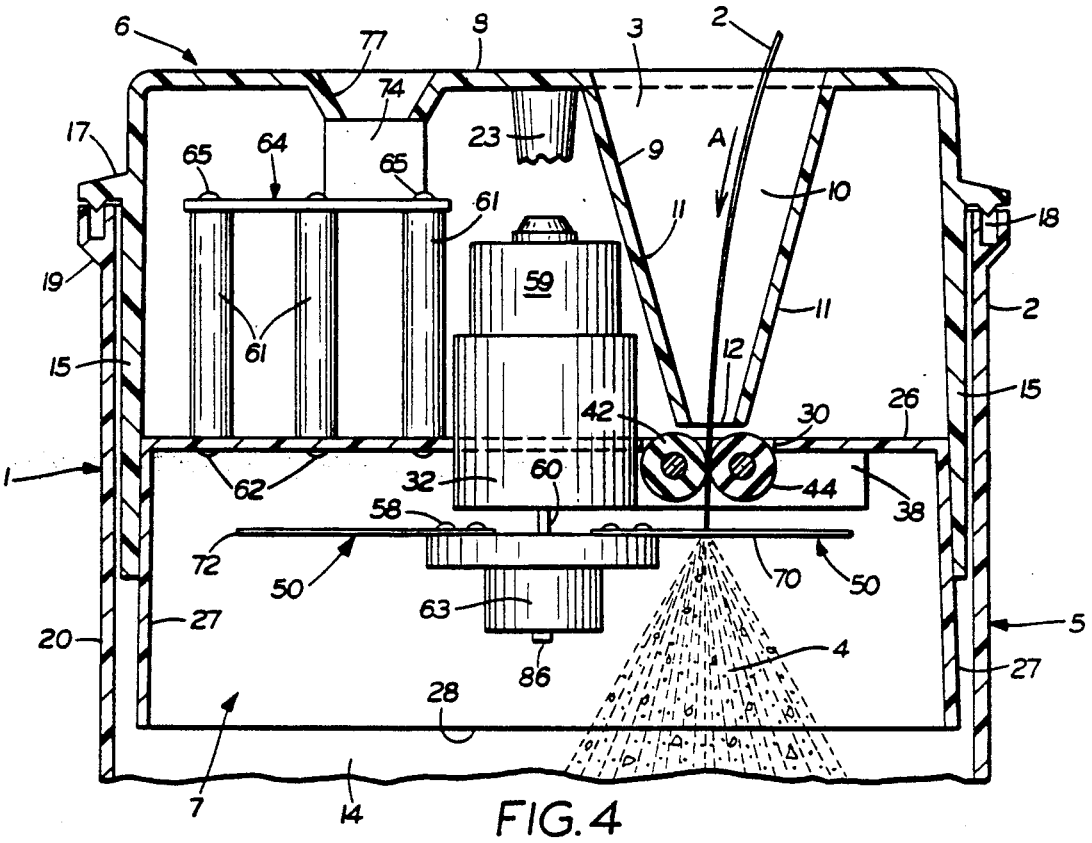
FIG. 4 is a fragmentary sectional view taken on line 4—4, FIG. 2, showing diagrammatically a piece of carbon paper being shredded by the cutting blade.
Figure 5:
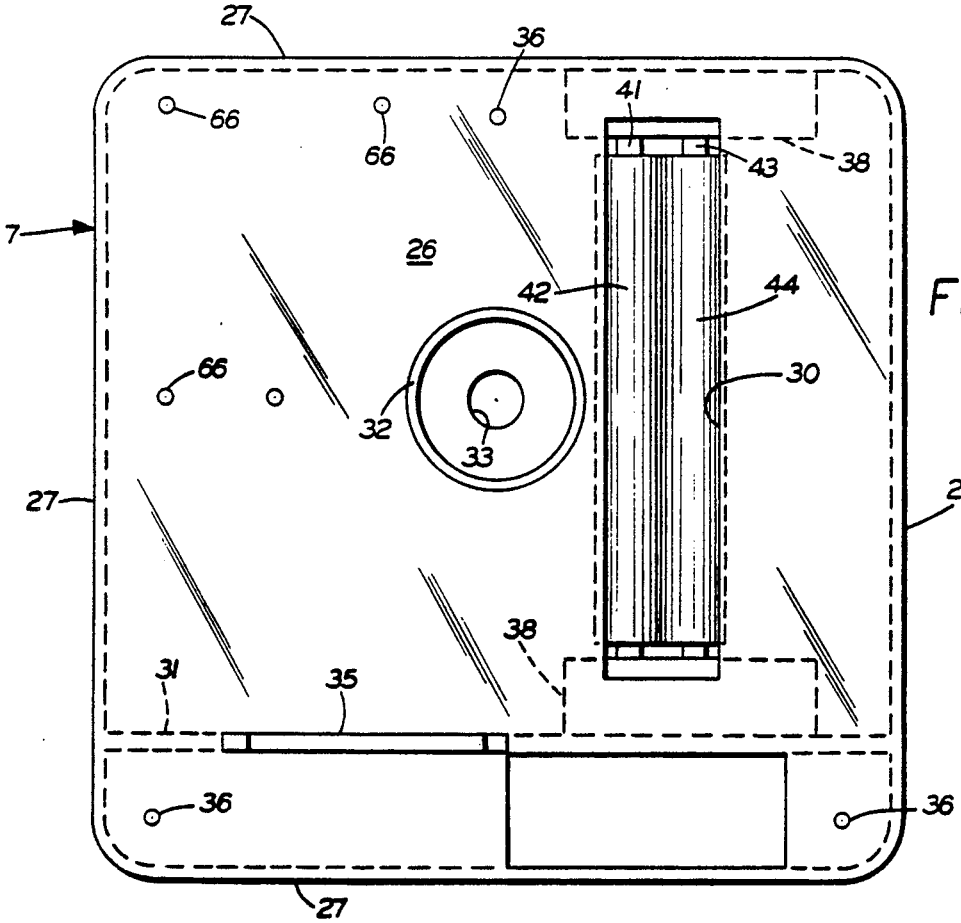
FIG. 5 is a top plan view of the middle section of the shredder with the top cover and collection receptacle removed.

The improved carbon paper shredder of the invention is indicated generally at 1, and is shown particularly in FIG. 1 with a piece of carbon paper shown in dot-dash lines being inserted into a top feed chute 3 thereof, for subsequent destruction into a plurality of indiscernible pieces of paper 4 (FIG. 4). Shredder 1 includes a lower hollow waste receptacle indicated generally at 5, a cover indicated generally at 6, and an intermediate or middle section indicated generally at 7, which are shown particularly in FIGS. 2-5. Components 5, 6 and 7 preferable are formed of a lightweight, rugged, high strength plastic enabling the shredder to be mass produced at a relatively low cost, and providing a unit which is relatively maintenance free and less susceptible to breakage and damage then if formed of other types of materials.

Figure 2:
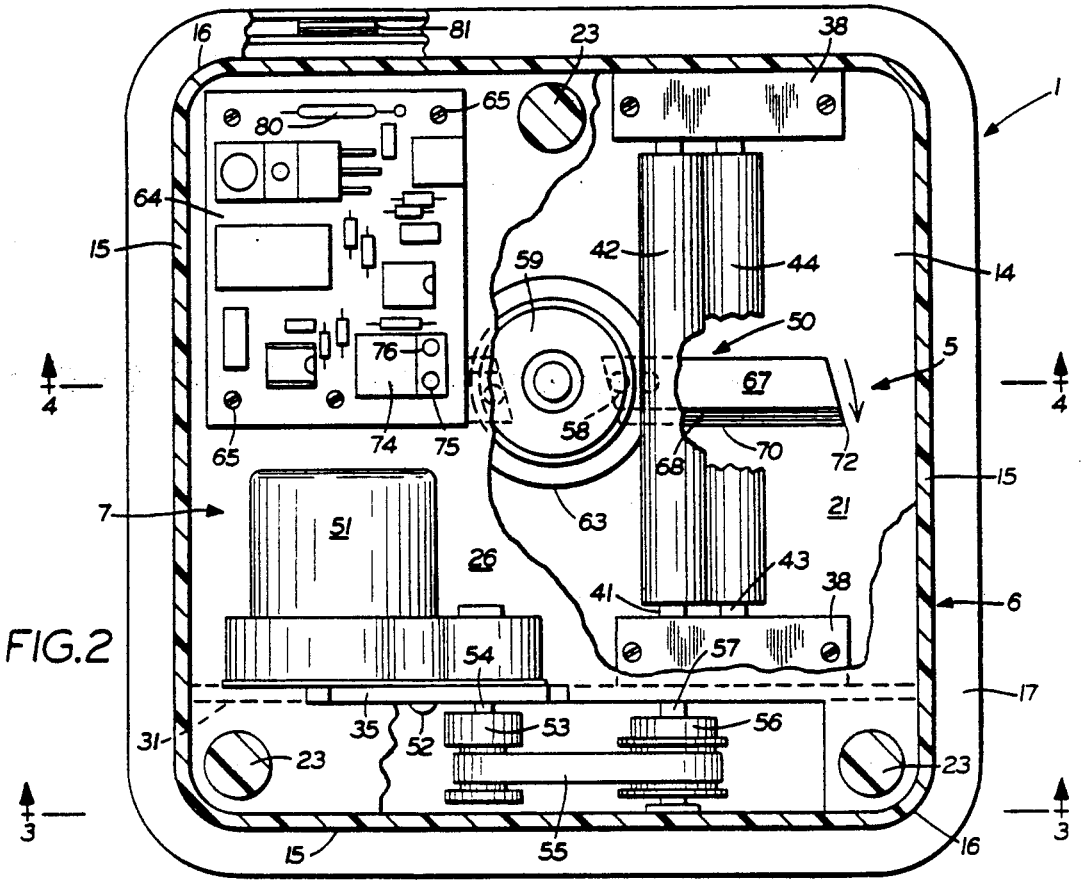
FIG. 2 is an enlarged fragmentary sectional view, taken on line 2—2, FIG. 1.

Referring particularly to FIGS. 2-5, cover 6 includes a top wall 8 having a feed opening 9 formed therein, which communicates with feed chute 3 formed by generally vertically extending end walls 10 and a pair of opposite sloped side walls 11. Chute 3 terminates in a bottom end opening 12 which communicates with hollow interior 14 of waste receptacle 5. Cover 6 preferably has a generally rectangular configuration as shown in FIG. 2, formed by walls 15 which meet at generally right angle corners 16. A simplified flange 17 is formed about the outside of walls 15 and is adapted to set within a recess 18 of a peripheral flange 19 (FIG. 3), which is formed about the upper end of side walls 20 of receptacle 5. Waste receptacle 5 also has a generally rectangular configuration complementary to that of top cover 6 and has a bottom wall 21 which in combination with side walls 20, provide the enclosure for receiving and containing carbon paper bits 4. Cover 6 is removably mounted on and sets upon receptacle 5 with peripheral flange 17 resting upon peripheral flange 19 of waste receptacle 5.

A plurality of standoff posts 23 are formed integrally with top wall 8 of cover 6 and extend downwardly from the inside surface thereof. Three of these posts are shown in FIG. 2 for mounting intermediate section 7 onto cover 6 by fasteners 24 as shown particularly in FIG. 3. Cover 6 preferably is integrally molded as a one-piece member including chute 3, standoff posts 23, top wall 8, side walls 15 and flange 17.

Intermediate section 7 (FIGS. 3, 4 and 5) also is integrally molded as a one-piece member and includes a top wall 26 and four downwardly depending side walls 27 which form a generally rectangular configuration, which is shaped and sized so as to be slideably received within the interior of side walls 15 of cover 6 as shown particularly in FIGS. 3 and 4. The bottom of intermediate section 7 is opened at 28 so that carbon paper pieces 4 can fall freely after being cut, into hollow interior 14 of receptacle 5. Top wall 26 of intermediate section 7 also is formed with a elongated rectangular shaped opening 30 immediately below bottom opening 12 of chute 3. Section 7 further includes a side partition wall 31, a cylindrical cup-shaped member 32 having a bottom opening 33 therein, and a vertical upstanding mounting bracket 35. A plurality of holes 36 are formed in top wall 26 for inserting fasteners 24 therethrough for engagement with standoff posts 23 to mount intermediate section 7 on cover 6 as described above.

Figure 7:
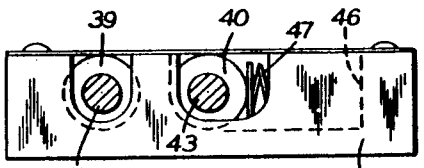
FIG. 7 is a fragmentary sectional view taken on line 7—7, FIG. 6.
Figure 6:
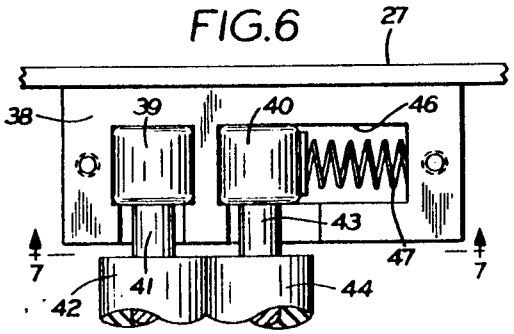
FIG. 6 is an enlarged fragmentary top plan view showing the mounting of one end of the feed rolls.

A pair of bearing housings or mounting chambers 38 are formed opposite of each other on top wall 26 of intermediate section 7 (FIGS. 6 and 7) for receiving a pair of bearings 39 and 40 therein. Bearing pairs 39 rotatably mount shaft 41 of a feed roll 42 with bearings 40 rotatably mounting shaft 43 of a second feed roll 44. As shown in FIG. 6 bearings 40 are adjustably mounted within a slot 46 and are spring biased by coil springs 47 toward roll 42 to provide a predetermined engagement tension between feed rolls 42 and 44. Feed rolls 42 and 44 preferably are rubber covered so as to provide a gripping driving relationship with the carbon paper when inserted into feed chute 3. The feed rolls extend horizontally beneath chute opening 12 and are located closely adjacent thereto (FIG. 4) for gripping the carbon paper and moving it at a predetermined speed in the direction of arrow A into the path of a pair of cutting blades, each of which is indicated generally at 50, for cutting the paper into pieces 4.

Preferably a pair of similar blades 50 are mounted in a diametrical relationship by screws 58 onto a blade mounting block 63 which is secured by a mounting screw 86 to a blade arbor 88 which is secured to the bottom of motor shaft 60.

Feed roll 42 is driven by a motor 51 which is mounted by a plurality of bolts 52 on mounting bracket 35. A timing pulley 53 is mounted on an output shaft 54 of motor 51 and is drivingly connected by a timing belt 55 to another timing pulley 56 mounted on the extended end 57 of feed roll shaft 41. Rotation of motor shaft 54 by motor 51 will drive feed roll 42 and correspondingly will rotate feed roll 44 which is spring biased into driving engagement therewith by springs 47. Motor 51 preferable will be a 6 volt or 9 volt DC motor having a rotational speed of between 35 RPM and 70 RPM, which depending upon the particular relationship between timing pulleys 53 and 56, will rotate feed rolls 42 and 44 at a speed to provide a paper feed rate of between 0.25 and 1.50 inches per second. This paper feed rate in combination with the rotational speed of cutting blade 50, has been found to provide the desired speed relationship to produce the most efficient cutting effect of carbon paper 2 in bits 4.

Another DC drive motor 59 is mounted within cup-shaped member 32 with its shaft 60 extending through opening 33 for mounting of blades 50 thereon as described above. Blade drive motor 59 preferable will be a 6 volt or 9 volt DC motor similar to that of feed roll motor 51 but having a rotational speed of approximately 10,000 RPM. As shown particularly in FIG. 4, blades 50 rotates in a horizontal plane and is mounted beneath motor 59. This mounting arrangement enables the blades to be changed easily without removing motor 59 after cover 6 and intermediate section 7 is manually removed or lifted off of waster receptacle 5. If desired, a single cutting blade 50 can be used without effecting the concept of the invention.

A plurality of standoff posts 61, four of which are used in the particular construction shown in the drawings, are mounted on top wall 26 of intermediate section 7 (FIG. 4) and project vertically upwardly therefrom and are secured thereto by fasteners 62. If desired, posts 61 maybe molded integrally with top wall 26 of section 7. A printed circuit board indicated generally at 64, is mounted on the top of posts 61 by fasteners 65. Fasteners 62 extends through holes 66 formed in top wall 26 as shown particularly in FIG. 5.

Figure 9:
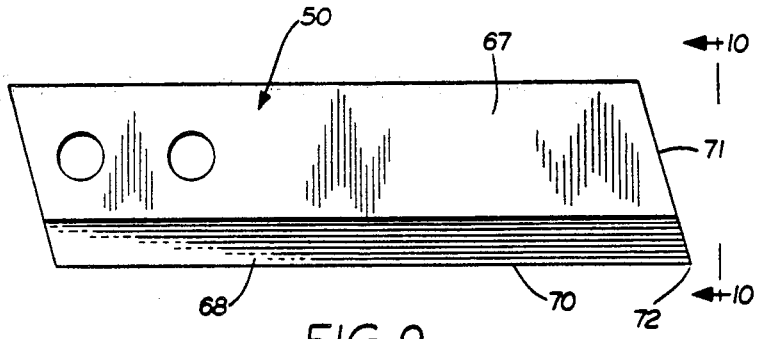
FIG. 9 is an elevation view of one of the cutting blades of the shredder.
Figure 10:
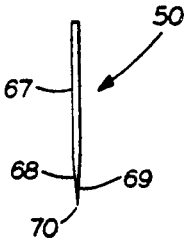
FIG. 10 is an end elevational view of the cutting blade looking in the direction of Arrows 10—10, FIG. 9.
Figure 11:
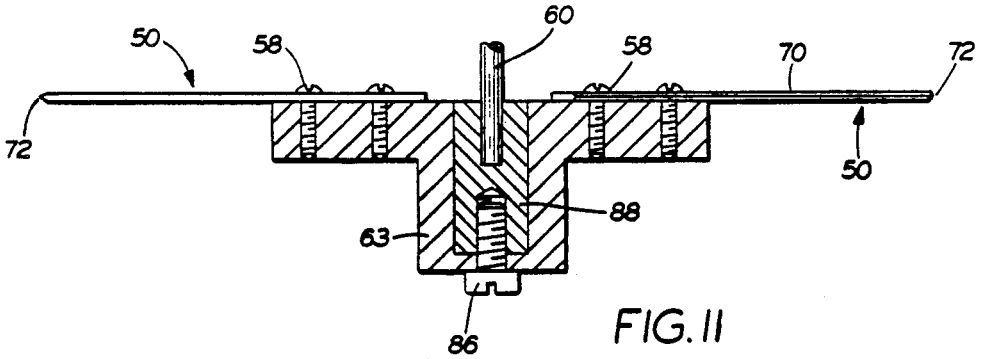
FIG. 11 is a fragmentary sectional view of a pair of cutting blades mounted on the motor drive shaft.

In accordance with one of the features of the invention, blades 50 (FIGS. 9 and 10) are relatively thin blades having a main generally flat body 67 and a pair of doubled-tapered edges 68 and 69 which terminate in a sharp edge 70. A leading end 71 of blade 50 preferable is tapered to provide a sharp corner 72 at the junction with cutting edge 70 and has been found to be extremely effective in starting the cut for severing of the carbon paper upon contact therewith.

In accordance with another of the features of the invention, a control circuit indicated generally at 73 (FIG. 8), is incorporated into circuit board 64 for controlling the operation of shredder 1 as described below, and particularly for controlling the operation of cutting blade 50 and feed rolls 42 and 44. The control circuitry includes a single pushbutton 74 which includes a pair of indicating lights 75 and 76, and is located in a recess 77 formed in top wall 8 of cover 6 (FIGS. 1 and 4).

The control circuit further includes a plug-in power converter 78 which is mounted on the end of a power supply cord 79, for converting the incoming 120 volt AC power into 6 or 9 V/DC for use throughout the remainder of the control circuitry. It is readily understood that 9 volts DC could be used for the control circuitry instead of the 6 volts DC as shown in the particular schematic wiring diagram of FIG. 8, without effecting the concept of the invention.

In accordance with another feature of the invention a magnetic reed switch 80 (FIGS. 2 and 8) is mounted on circuit board 64 in close proximity to a permanent magnet 81 which is mounted within peripheral flange 19 of waste receptacle side wall 20. Reed switch 80 and magnet 81 provide a safety interlock so that unless cover 6 is in its enclosing position on top of waste receptacle 5, reed switch 80 and magnet 81 are sufficiently removed from each other so that switch 80 remains open and prevents the remainder of the control circuit from being energized preventing actuation of drive motors 51 and 59. This prevents the motors, and in particular the cutting blades, from accidentally cutting a user when the blades are exposed by removal of cover 6 from receptacle 5.

Control Circuitry 73 furthermore includes a timing circuit 83 which provides a ten second time interval so that upon momentary depression of pushbutton 74, assuming reed switch 80 is closed, will maintain drive motors 51 and 59 energized for 10 seconds or other selected time interval. The control circuitry furthermore includes a reversing relay 84 which controls a reversing circuit 85. Should the shredder start to jam, the operator merely presses and holds pushbutton 74 and within one quarter to one-half second, relay 84 will actuate reversing circuit 85 which will immediately reverse the polarity of drive motors 51 and 59 and reverse the rotational direction of feed rolls 42 and 44 and the direction of rotation of cutting blades 50 to remove the jam occurring in the shredder.

The control circuit also includes as several of its main components, power transistor 87 for controlling drive motors 51 and 59, and indicating lights 75 and 76. In the present embodiment, light 75 will be green and light 76 will be red. Green light 75 will be illuminated at all times when electric power is supplied to the shredder indicating that the shredder is in condition for operation. Immediately upon pressing pushbutton 74, red indicating light 76 will be illuminated and remain on during the 10 second operating time interval previously described.

As discussed above pushbutton 74 is a momentary action type where the operator need only momentary depress the button to energize drive motors 51 and 59, initiate timing circuit 83, and illuminate shredding indicating light 76. The operator then merely inserts carbon 2 into chute 3 where its rate of feed is controlled by feed rolls 42 and 44. As the paper extends beneath the rolls as shown in FIG. 4, it will be cut into a vast number of indiscernible pieces by cutting blades 50. The location of blades 50 closely adjacent to and beneath feed rolls 42 and 44, enables the rolls to maintain a firm grip on the carbon paper preventing the paper from being rapidly pulled through and past the cutting blades. The rolls ensure that the paper is fed at the desired rate so as to be completely and thoroughly cut into pieces 4 by blades 50.

It has been found that the high speed rotation of extremely thin and sharp blades 50 at a rotational speed of between 8,000 and 1,200 RPM, in combination with the controlled feed rate of carbon paper 2 at a rate of between 0.25 and 1.50 inches per second, enables the blades to cut the carbon paper into the desired number of pieces 4. Should a jam occur or start to occur during the shredding of carbon paper 2, the operator merely holds button 74 down, which within ¼ to ½ second, reverses the rotation of motors 51 and 59. So long as the operator maintains the pressure on button 74 the motors will rotate in the opposite directions. Upon clearing of the jam the operator merely releases his or her pressure on button 74 which will reverse the motors to their forward directions and complete the ten second timing sequence, after which the motors are automatically deenergized by the timing circuit. The operator needs to press and hold the pushbutton for the ¼ or ½ second whichever is built into the reversing circuitry 85, before motors 51 and 59 begin to reverse, which prevents momentary contact with the button from energizing the reversing circuit.

A thermal overload switch 90 is provided and is mechanically coupled to power transistor 87 to avoid damaging the circuitry, motors etc. should a jam occur for an extended period of time.

Figure 8:
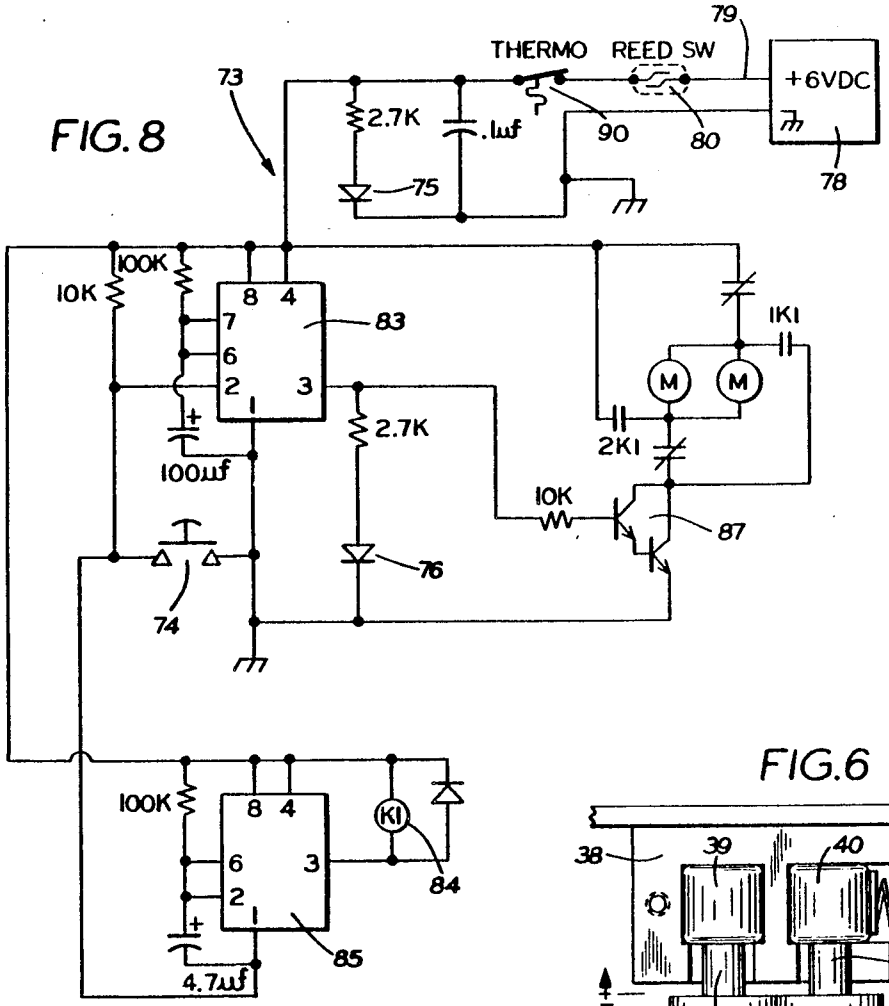
FIG. 8 is a schematic wiring diagram of the control circuitry of the shredder.

The remaining components of control circuitry 73 are not described in detail but are shown in the schematic wiring diagram of FIG. 8 and are readily understood and known to those skilled in the art. Other types of circuitry arrangement could be utilized to provide similar features as that of circuitry 73 discussed above, to provide for the desired results of the invention. Likewise the length of the timing circuit 83 and reversing circuit 85 could be modified without effecting the concept of the invention. Also, the various sizes and ratings of the drive motors and circuit components set forth in FIG. 8 can also vary and still provide the same results of those achieve by circuitry 73.

Thus, improved shredder provides an extremely compact, sturdy and durable unit, which can be produced relatively inexpensive in contrast to most existing shredders to enable most business establishment to place a shredder at each checkout location where it is easily connected to a readily available source of 120 volts AC power, yet operate at either 6 or 9 volts DC to prevent possible injury to the user and/or customer of the establishment; which is provided with safety interlock reed switch 80 to prevent the cover from being removed and the blades and feed rolls remain actuated; in which the cover can be easily lifted off of the receptacle and the shredded paper bits be emptied therefrom in a convenient manner, afterwhich the cover is replaced and the reed switch automatically operated to place the control circuitry in condition for actuation; and in which the complete control of the shredder is accomplished by a single pushbutton which provides the reversing feature thereof together with the shred timing circuitry. This circuitry in combination with the high speed rotation of the ultra-thin cutting blades and the controlled feed rate of the carbon paper, and the movement of the paper generally perpendicularly into the path of the cutting blades as shown in FIG. 4, and the location of the cutting blades closely adjacent the exit of the feed rolls, enables the carbon paper to be completely cut into a sufficient number of pieces making it nearly impossible to reconstruct the paper and obtain the confidential information contained thereon.

Accordingly the carbon paper shredder and method of the invention is simplified, provides an effective, safe, inexpensive, and efficient device and method which achieves all the enumerated objective, provides for eliminating difficulties encountered with prior devices and methods, and solves problems and obtains new results in the art.

In the foregoing description, certain terms have been used for brevity, clearness and understanding; but no unnecessary limitation are to be implied therefrom beyond the requirement of the prior art, because such terms are used for descriptive purposes and are intended to be broadly construed.

Moreover, the description and illustration of the inventing is by way of example, and the scope of the invention is not limited to the exact details shown or described.

Having now described the features, discoveries and principles of the invention, the manner in which the improved carbon paper shredder and method is constructed and used and the method steps carried out, the characteristics of the construction and method, and the advantageous, new and useful results obtained; the new and useful structures, devices, elements, arrangements, parts, combinations and method steps, are set forth in the appended claims.

I claim:

1. A method of shredding carbon paper into indiscernible pieces including the steps of:

a) providing a thin cutting blade with a double beveled cutting edge;

b) rotating said cutting blade in a generally horizontal plane at a speed of generally within the range of 8,000 rpm and 12,000 rpm;

c) feeding a piece of carbon paper at a predetermined speed generally perpendicularly into the cutting path of said rotating blade to cut said carbon paper into the indiscernible pieces; and d) collecting the pieces of carbon paper in an enclosed container located beneath the cutting blade.

2. The method defined in claim 1 including the steps of actuating a switch to rotate the cutting blade and to feed the piece of carbon paper into the path of the cutting blade with a pair of feed rolls; maintaining the cutting blade rotating and the feed rolls feeding the carbon paper for a predetermined time interval; and automatically stopping the cutting blades and feed rolls after said time interval.

3. The method defined in claim 2 including the step of providing a visual indicating signal during the time interval that the cutting blade is rotating.

4. The method defined in claim 2 including the step of simultaneously reversing the direction of rotation of the cutting blade and rotation of the feed rolls to prevent jamming of the cutting blade upon actuating the switch while the cutting blade is rotating.

5. The method defined in claim 1 including the step of feeding the carbon paper into the path of the cutting blade at a speed of between generally 0.25 and 1.50 inches per second.

6. The method defined in claim 1 including the step of disabling the rotation of the cutting blade upon the collection container being moved with respect to the cutting blade.

* * * * *